US005481854A

United States Patent [19]

Van Newkirk

[11] Patent Number: 5,481,854

[45] Date of Patent: Jan. 9, 1996

[54] METHOD OF AND APPARATUS FOR INSERTING TRAYS OF ARTICLES INTO SLEEVES

[75] Inventor: Carl D. Van Newkirk, Ellicott City, Md.

[73] Assignee: Carter Control Systems, Inc., Frederick, Md.

[21] Appl. No.: 127,040

[22] Filed: Sep. 24, 1993

[51] Int. Cl.[6] ..... B65B 43/24; B65B 43/44

[52] U.S. Cl. ..... 53/458; 53/566; 53/504; 53/74; 53/252; 53/258

[58] Field of Search ..... 53/566, 452, 458, 53/504, 74, 168, 169, 252, 258, 48.1, 67

[56] References Cited

U.S. PATENT DOCUMENTS

| | | | |
|---|---|---|---|
| 1,417,591 | 5/1922 | Anderson | 53/566 |
| 1,831,837 | 11/1931 | Baldenhofer | 53/566 |
| 3,134,309 | 5/1964 | Weber | 53/566 |
| 3,220,159 | 11/1965 | Killeen | 53/566 |
| 4,081,945 | 4/1978 | Calvert et al. | 53/186 |
| 4,514,961 | 5/1985 | Gillie | 53/449 |
| 4,541,827 | 9/1985 | O'Dea et al. | 53/566 |
| 4,571,236 | 2/1986 | Adams | 53/566 |
| 4,735,600 | 4/1988 | Drewke et al. | 53/566 |
| 4,869,052 | 9/1989 | Calvert | 53/566 |
| 4,891,928 | 1/1990 | James et al. | 53/564 |
| 5,027,586 | 7/1991 | Ramaker | 53/566 |

FOREIGN PATENT DOCUMENTS

| | | | |
|---|---|---|---|
| 547854 | 10/1957 | Canada | 53/566 |

OTHER PUBLICATIONS

Brochure, *Kirk Automatic Tray Sleever,* Kirk Machinists, Baltimore, Md.

Brochure, *The System Integrators,* Carter Contorl Systems, Frederick, Md.

News Release, *Automated Mail Tray Processing System,* Litton Corporation, Beverly Hills, Calif. (Aug. 1993).

*Primary Examiner*—Daniel C. Crane

*Attorney, Agent, or Firm*—Burns, Doane, Swecker & Mathis

[57] ABSTRACT

An apparatus for automatically inserting a tray of articles, such as a tray of letters for mailing, into a tubular packaging sleeve includes a conveyor for positioning a tray at an inserting position, and a sleeve carrier to move a sleeve into position for inserting the tray in the sleeve. The carrier includes a vacuum head for gripping a sleeve blank from the top of a sleeve supply, and sleeve forming plates for unfolding the blank into the tubular shape. The sleeve is positioned in axial alignment with the tray and a pusher arm pushes the tray into the sleeve. The invention includes automatic controls for initiating and controlling the sleeving operation without operator intervention. The invention includes a method of inserting a tray of articles in a sleeve using the apparatus.

27 Claims, 7 Drawing Sheets

FIG. 4
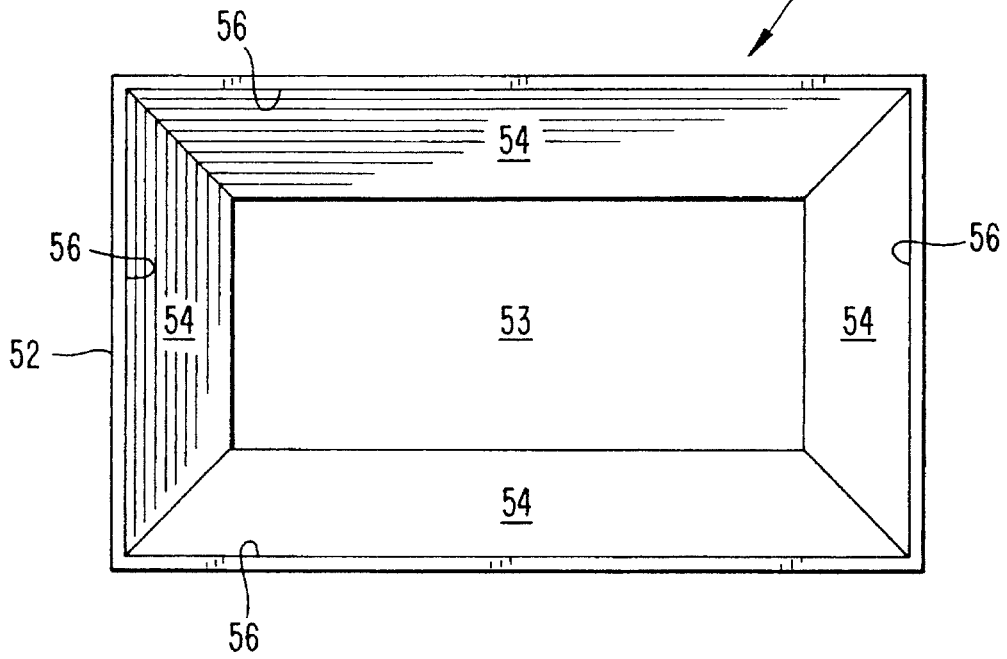
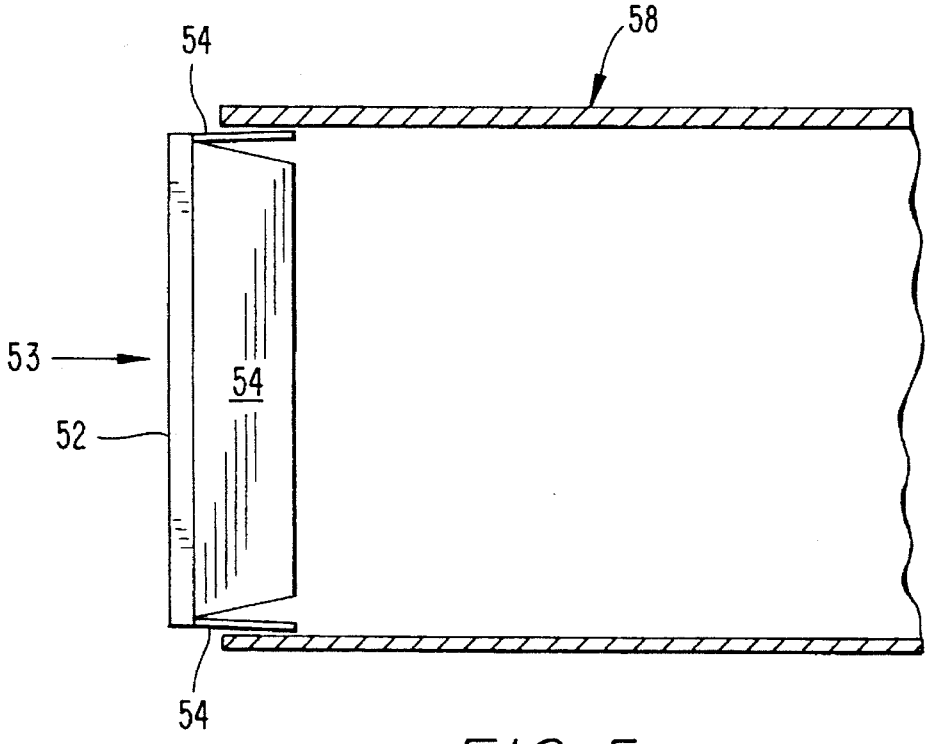
FIG. 5

METHOD OF AND APPARATUS FOR INSERTING TRAYS OF ARTICLES INTO SLEEVES

FIELD OF THE INVENTION

The present invention relates to methods and apparatus for packaging articles. More particularly, the present invention relates to a method of and apparatus for inserting a tray of articles into a sleeve of predetermined size.

BACKGROUND AND SUMMARY OF THE INVENTION

In systems for handling large numbers of articles, particularly articles that are small or difficult to handle, the handling procedures are facilitated if the articles are packaged in containers of predetermined size. Packages of predetermined size are easier for automated machinery to sort, convey and store, for example. One situation well suited to improvement by automated handling and packaging is the handling of mail or other documents. Businesses that move a high volume of documents internally within a site or among remote sites would benefit from an automatic system for sorting the documents for a particular location, packaging the sorted documents in packages of predetermined size to facilitate handling, and transporting the packages to the destinations.

A U.S. Postal Service (USPS) program permits high volume postal customers to reduce their mailing costs and the delivery time for their mail by presorting, packaging and labelling the mail to reduce the handling by the USPS. According to the program, customers should sort the mail for a particular zip code destination, and load sorted mail in a standard size tray. The tray must be sleeved in a cardboard cover. The sleeved tray is weighed to determined postal charges, and tagged with information on the weight, zip code and destination for the USPS. The tagged, sleeved tray is strapped, and finally delivered to the USPS.

The mail is packaged in standard sized mail trays and paperboard sleeves and securely banded. The trays for first and third class mail are in two different sizes, a standard size, designated MM, 4½ inches high, 10½ wide and 24 inches long, and a second, larger size, designated EMM, 6½ high and 11½ wide and 24 inches long. The sleeves are rectangular cardboard tubes, that come in two sizes to accommodate the standard trays. Customers receive the sleeves as flat, folded blanks. Unfolding a sleeve blank to open it to a tube, and inserting a mail tray in the sleeve is a labor intensive operation. There is a need, therefore, for an automatic system that can insert a mail tray into a sleeve as part of a larger mail handling system.

One obstacle to an automatic sleeving system relates to the ability of a system to store, feed and form sleeves reliably. The condition of the sleeves is a factor in mail packaging systems. To keep costs low, used sleeves are returned to customers and are reused as long as they are structurally intact. Over its useful lifetime, a sleeve is subject to wear and tear that can cause it to become creased and torn, and the edges and corners become frayed and dog-eared. The condition of a used sleeve makes it difficult for an automatic system to handle the sleeve to reliably obtain it from a supply device, unfold it to a proper shape and position it for inserting of a tray.

Packaging systems are typically designed for new, unused packaging materials, which can, for the most part, be consistently and reliably handled because of the uniform condition of the materials. Even new packaging materials are known to jam in feeding mechanisms because of friction between packages caused by the weight of a storage stack.

Known automatic mail tray sleeving systems have not overcome problems relating to handling used sleeves, and are subject to jams and misfeeding of the sleeves, requiring frequent operator intervention, and negating the time and manpower saving benefits such a system should provide. For example, one known system pulls sleeve blanks from the bottom of a sleeve hopper using a belt drive mechanism. The system relies on gravity to position the bottom sleeve blank properly for removal by the belt drive. Because the sleeves vary in condition, the movement of the sleeve blanks down through the hopper and from the hopper onto the belt is subject to jams and misfeeds. Also, because the weight of the sleeve stack varies with the number of sleeve blanks in the stack, gravity is unreliable for overcoming friction in the hopper to urge the sleeves into position for feeding to the belt. In addition, the hopper in this system is positioned above the conveyor, so that an operator loading the hopper may have to lift sleeves six feet or more above the floor, leading to a potentially unsafe environment for the operator.

The present invention, generally, provides an automatic system for inserting a tray of mail in a sleeve of predetermined size. The method of the present invention may be easily integrated in an overall document delivery preparation procedure. Although the invention is described in the context of mail trays and standardized tray sleeves, the apparatus and method of the invention is applicable to inserting trays or similar shaped containers in packaging sleeves or tubes, and should not be construed to be limited to the described functions.

The present invention provides a method and apparatus wherein new or used sleeve blanks may be reliably lifted from the top of a blank supply, formed into an open sleeve, positioned in line with a tray, and the tray inserted into the sleeve. The apparatus of the present invention eliminates the problems of jamming and misfeeding of sleeve blanks of the prior art.

More particularly, the present invention provides a method for handling articles, comprising the steps of positioning a tray of articles for inserting the tray in a sleeve, obtaining an uppermost sleeve blank from a supply of sleeve blanks, lifting the sleeve blank from the top of a supply to a position above the supply, forming the sleeve blank into a tubular sleeve, moving the formed sleeve from the supply of sleeve blanks to a tray accepting position, and inserting the tray of articles into the formed, positioned sleeve.

Obtaining and lifting sleeve blanks from the top of a stack overcomes problems in reliably feeding blanks for handling related to the condition of the blanks. The blanks are gripped on flat portions that retain their shape and condition longer than the edges and corners of the sleeve. The invention includes means for sensing that a blank has been obtained, and the forming means is especially configured to ensure that blanks of any useful condition are formed into the proper rectangular tube shape.

Another aspect of the method of the present invention includes steps for automatically sensing operating events and conditions, and activating other operations in response to those conditions. The sensing steps include sensing a tray received at the apparatus for initiating the steps of positioning the tray for sleeving, sensing the transfer unit in contact with a sleeve blank to initiate blank gripper means, sensing the tray and a prepared sleeve in position for inserting a tray in the sleeve to initiate the tray inserter.

Another aspect of the present invention provides an apparatus for automatically inserting a tray of letters in a cardboard sleeve.

The apparatus of the present invention includes means for positioning a tray of articles for sleeving in a sleeve, inserting means for inserting the tray in the sleeve, sleeve blank supply means for maintaining an uppermost blank of a blank supply at a predetermined position, gripper means for gripping an uppermost blank from the stack, transfer means for transferring the gripped blank to a position for sleeving, and forming means for forming the blank to a sleeve shape.

In a preferred embodiment of the apparatus, the gripper means comprises a head for contacting the blank and means for drawing a vacuum in the head sufficient to hold the blank against the head.

In order to reliably load the blanks on the gripper means, the sleeve blank supply means includes means for maintaining the blanks in stacked vertical relationship, and an elevator for lifting the stacked blanks so that the uppermost blank is at predetermined position.

Operator safety and efficiency are provided for in another aspect of the apparatus in which a blank loading station is provided. The loading station is positioned for easy access by an operator through a door, and accepts a multiplicity of blanks. A loading ram positions the accepted blanks for lifting by the elevator after the door is closed.

The sleeve forming means comprises forming plates that contact the blank held in the gripper and move by actuators to a position whereby the blank is unfolded to form the blank into a sleeve. The forming plates cooperating with the gripper means to maintain the sleeve form during transferring the sleeve and inserting the tray. In another aspect of the forming means, the sleeve forming means includes means for adjusting the forming means to accommodate one of the two standard sleeve sizes MM and EMM.

The apparatus of the present invention includes systems for automatically controlling the operation of the system. These systems include, means for sensing a tray in position for sleeving, means for sensing the gripper means being in position for gripping a blank, means responsive to the gripper sensing means to activate the gripper to grip a blank, means for sensing a blank being gripped by the gripper means, means responsive to the gripped blank sensing means for activating movement of the transfer means to lift the gripped blank to an upper horizontal movement position, and then to move the gripped blank from the blank supply to a position above the sleeving position, and then to lower the gripped blank to the sleeving position, means responsive to the horizontal movement of the transfer means to activate the sleeve forming means, and means responsive to the formed sleeve and tray being in position for sleeving for activating the tray inserting means.

BRIEF DESCRIPTION OF THE DRAWING FIGURES

The present invention can be further understood with reference to the following description in conjunction with the appended drawings, wherein like elements are provided with the same reference numerals. In the drawings:

FIG. 4 is a front view of a tray insert guide;

FIG. 5 is a side view of the tray insert guide of FIG. 4;

DETAILED DESCRIPTION OF PREFERRED EMBODIMENTS

An automatic tray sleeving apparatus of the present invention is designed for integration in an article handling system. A tray of presorted articles is conveyed to the apparatus, where it is received and automatically sensed, which initiates the tray positioning apparatus. The received tray is then conveyed to a tray sleeving position. A sleeve transfer apparatus automatically moves to a sleeve blank supply and obtains a sleeve blank from the top of the supply. The transfer apparatus lifts the sleeve blank from the supply and transfers it to a position for accepting a tray, while simultaneously forming the blank into an open sleeve. When the open sleeve is properly positioned by the transfer apparatus, a tray inserter inserts the waiting tray into the sleeve. A sensor confirms that the tray is inserted in the sleeve, the transfer apparatus releases the sleeved tray to a conveyor for further handling, and the tray inserter and transfer apparatus return to a starting position for the next tray.

Figure 1:
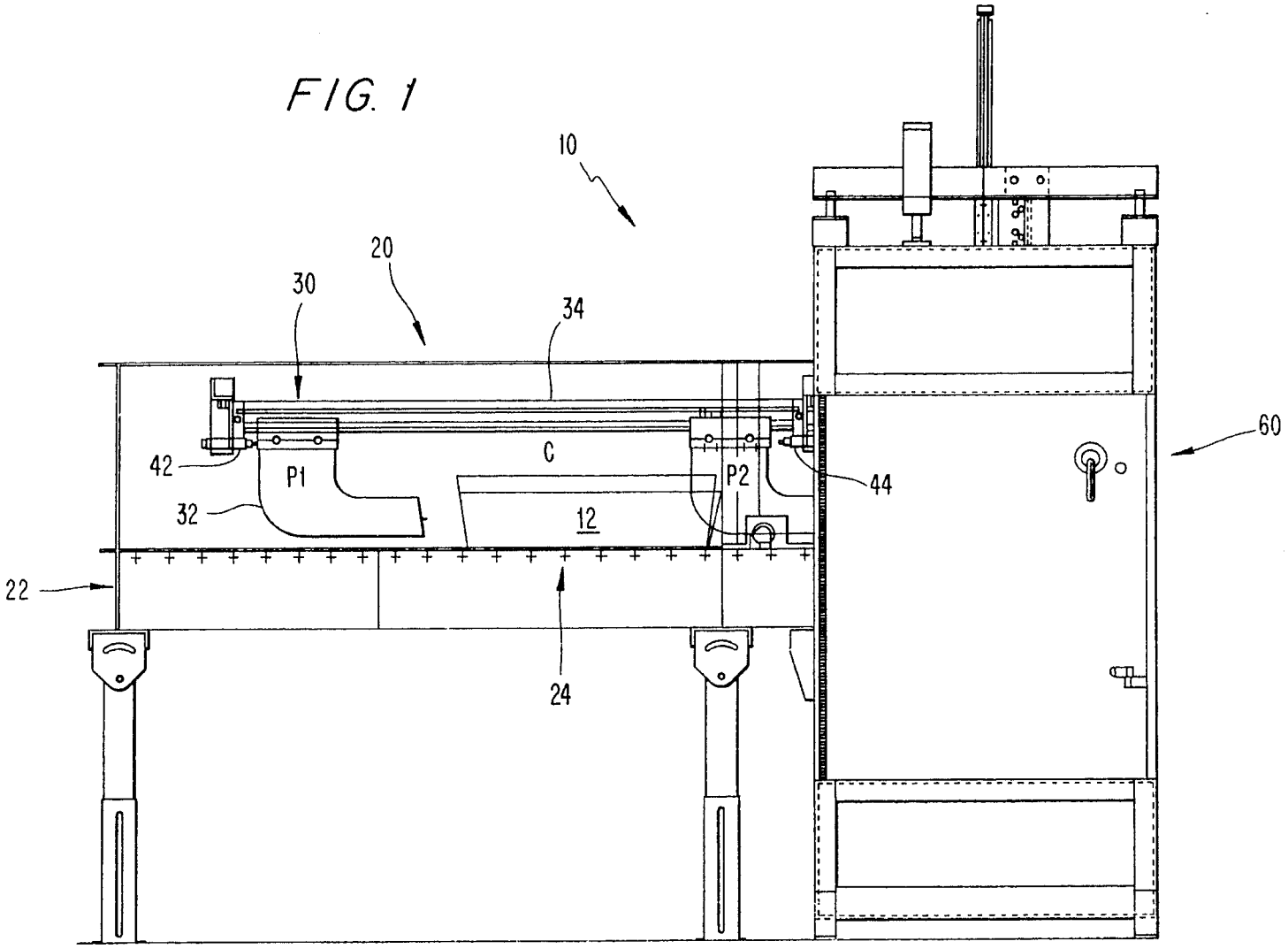
FIG. 1 is a front view of an automatic tray sleeving apparatus of the present invention.
Figure 2:
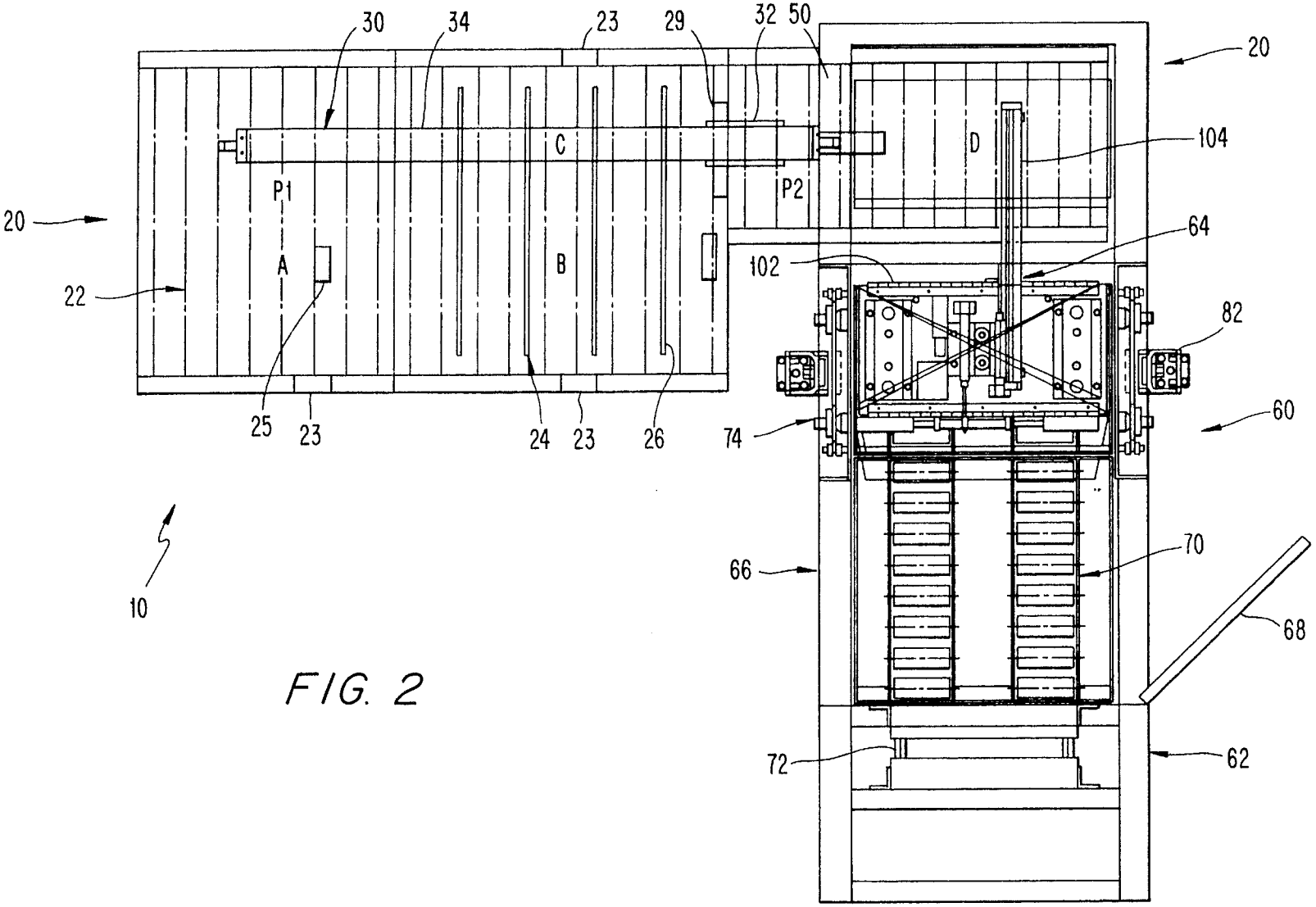
FIG. 2 is a top view of the apparatus of FIG. 1.
Figure 3:
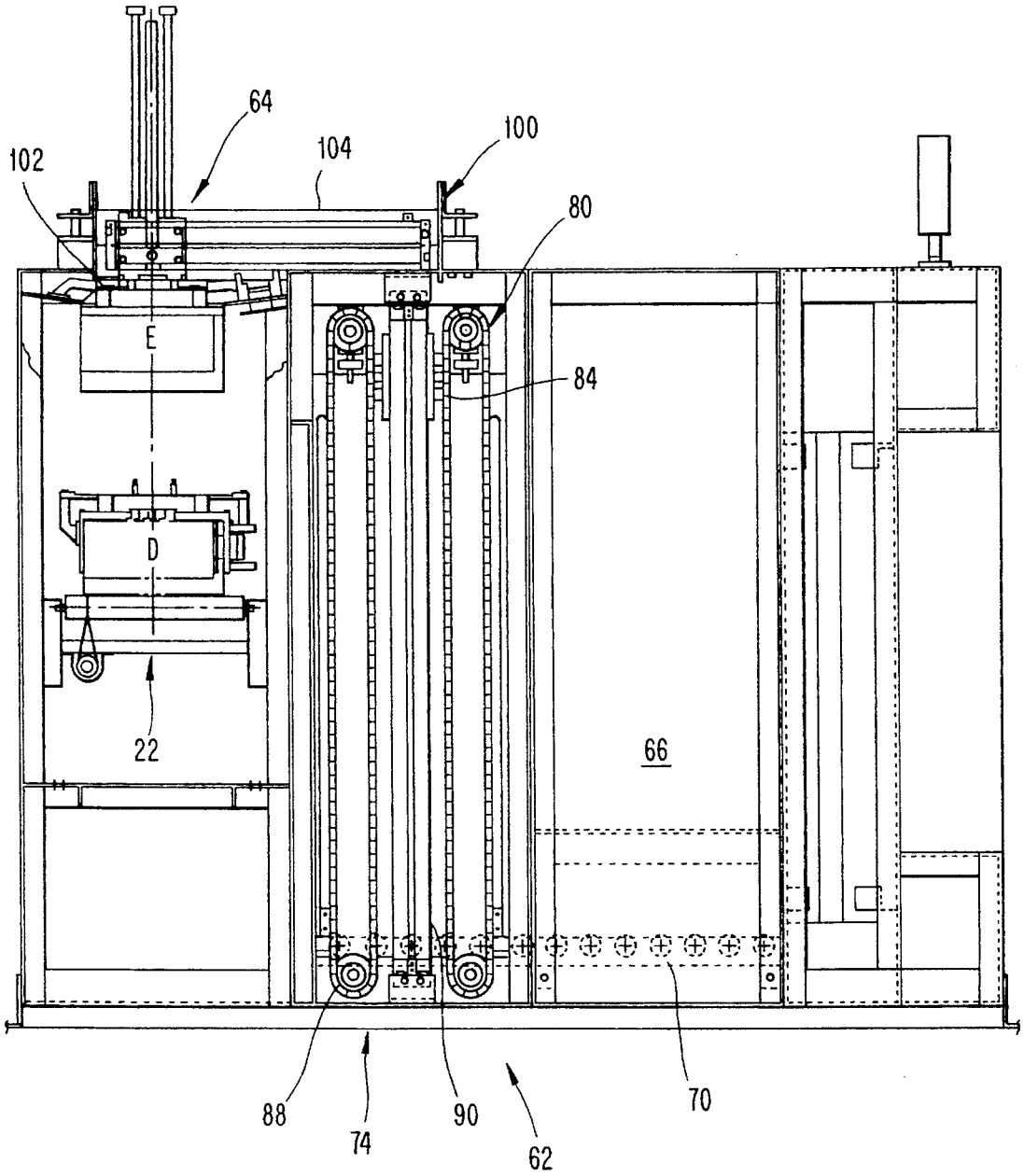
FIG. 3 is a side view of the apparatus of FIG. 1.

The automatic tray sleeving apparatus of the present invention can be understood with reference to FIGS. 1–8. FIG. 1 is a front view of an apparatus 10 for automatically inserting mail trays in standard sleeves according to the invention. FIG. 2 is a top view of the apparatus 10 of FIG. 1. FIG. 3 is a side view of the apparatus of FIG. 1.

The sleeving apparatus 10 includes three modules: a tray inserter module 20 for receiving loaded trays and inserting the trays in a sleeve; a sleeve supply module 60 for holding sleeve blanks ready for transfer to the inserter module; and, a sleeve preparation module 64 that obtains sleeve blanks from the supply module 60, forms the blanks into open sleeves, and positions the blanks at the inserter module for insertion of a tray.

The tray inserter module 20 includes a conveyor 22 comprising a suitable roller conveyor for moving a tray to the tray inserter module from an upstream mail sorting station (not illustrated), as is known in the material handling art. A tray of mail is first received by the conveyor 22 at position A. Tray position sensing means 23 senses the tray at position A and at various positions in the tray inserter module 20. Signals from the tray sensing means 23 are used to initiate and control various operations, as further described below. In a preferred embodiment, the tray sensing means 23 comprises a plurality of photocell devices suitably positioned and integrated to monitor the various tray positions in the inserter module 20.

A roller brake 25 halts forward movement of the tray at position A. The roller brake 25 comprises a pneumatically actuated cylinder having a friction surface that moves upward to stop the rollers in the conveyor 22 path to hold the tray in the position A. Tray position sensing means 23 senses a tray in the position A. If the sensing means 23 senses that the conveyor immediately downstream of position A is clear, the roller brake 25 releases the tray, which then moves to position B. A subsequent tray may then be received at position A from upstream tray handling stations. Tray position sensing means 23 senses a tray at position B and, if the next position is clear, activates a lateral conveyor 24 to move the tray 12 from the position B to a position C. In position C, the tray is in operational relationship with tray inserting means 30. The lateral conveyor 24 includes a plurality of narrow drive belts 26 which operate between the rollers of the conveyor 22. When activated, the drive belts 26 rise between the rollers to engage the tray and move to position 27. Other lateral conveyor means for moving the tray to the position 27 are possible, including pusher bars or chain drive mechanisms. A second tray stop 29 prevents the tray from moving forward from the position C until the inserter function is activated.

The tray inserting means 30 includes a pusher arm 32 for inserting the tray 12 into a sleeve. The pusher arm 32 is J-shaped to allow it insert a tray in a sleeve without interfering with the sleeve. The pusher arm 32 is carried by a pusher arm driver 34, which allows the pusher arm 32 to move reciprocally between a first position P1 behind a tray positioned at position C, and a second position P2 in which the tray is fully inserted in a positioned sleeve. The first P1 and second P2 pusher arm positions are best illustrated in the front view of FIG. 1. In FIG. 2, the pusher arm is illustrated at position P2. In a preferred embodiment of the invention, drive means 40 comprises a pneumatic drive device 34, for example, a pneumatic rodless piston and cylinder device. The drive device 34 is coupled to the push arm to move the pusher arm 32 between the positions P1 and P2. Sensing switches 42, 44 for sensing the pusher arm 32 at the first P1 and second P2 positions, respectively are provided as part of an automatic control system.

FIG. 4 illustrates a tray insert guide 50 which is provided adjacent to the inserting position D to guide a tray as it is being inserted into the sleeve and prevent the tray from catching on an edge of the sleeve. FIG. 5 is a side view of the insert guide 50 of FIG. 4, including a side section of a sleeve 58. Tray inserting means 50 comprises a frame 52 having a central opening 53 through which a tray is moved. Flap-like deflectors 54 are mounted to the frame 52 and biased to a position toward the central opening 53 in the path of a tray through the frame 52. As illustrated in FIG. 5, as the tray is pushed through the insert guide 50 by the push arm, the tray pushes against the deflectors 54, which in turn, open into the positioned sleeve 58 to form a funnel that guides the tray past the open edges of the sleeve and into the sleeve. The deflectors 54 are made of a suitable low friction material, such as nylon, to reduce friction with the passing tray. Conventional spring 56 means, for example, spring loaded hinges, bias the deflectors to a normal position in the tray path.

The sleeve supply module 60 stores sleeve blanks ready for use by the sleeve transfer means 64. The sleeve transfer means 64, which is described more fully below, takes a sleeve blank from the supply station 74, lifts the blank from the station, unfolds the blank to form an open sleeve 75 (FIG. 3), and laterally transfers the sleeve to the sleeving position 22, and lowers the sleeve to a position D illustrated in FIG. 2 and FIG. 3, for insertion of a tray into the sleeve.

The sleeve supply module 60 includes a loading station 66 accessed by a door 68. Sleeve blanks are preformed and creased rectangular tubes that are stored in a flattened state to facilitate handling. The blanks are handled by the supply module 60 as a vertical stack. An operator loads a stack of blanks in the loading station 66 on a blank conveyor 70, and closes the door 68. A movable wall 72 moves the stack from the loading station 66 on the stack conveyor 40 to a blank supply station 74. The movable wall may be driven by any suitable means. The movable wall 72 remains in position in the supply station 74 as the stack is used. The movable wall 72 is provided with means to control the movement of the wall for either of the MM or EMM size sleeves. In a preferred embodiment of the invention, the wall control means comprises a sensor that determines the size of the sleeve blank loaded by the operator, for example, a suitably positioned photocell device. Alternatively, the wall control means can be operated externally by an operator controlled switch.

Referring to FIG. 3, the blank supply station 74 includes means 80 for positioning the blanks at a predetermined position to be gripped by the transfer means 64. The blank positioning means 80 comprises an elevator 82 for raising the stack of blanks so that the uppermost blank is at a predetermined height in the supply station 74. Stack sensing means 84 senses whether a sleeve blank is in the proper position and the elevator is activated in response to the stack sensing means.

By positioning the stack so that an uppermost blank, that is, a blank on the top of the stack, is in a predetermined position, the transfer means 84 can reliably locate and grip the blank. Providing blanks at the top of a supply of blanks, rather than feeding blanks from the bottom as is conventionally practiced in the art, eliminates many of the feeding problems relating to the condition of the blanks. Used sleeve become ragged and dog-eared at the edges, which makes them difficult to handle with feeding mechanisms feed the blanks edge first, or that index or otherwise rely on the edges for positioning the blanks. The present invention, which grips the blank on a flat surface is more reliable because the flat surfaces of the blank remain intact longer than the edges and corners. In addition, the use of an elevator 82 to position the blanks eliminates the inconsistency of gravity feeding device that rely on the weight of a stack of blanks as the driving force for positioning the blanks.

The elevator 82 includes a movable platform driven by a suitable drive means 88, which in the preferred embodiment comprises a pneumatic cylinder acting through a chain drive transmission. The blank supply station 74 includes vertical supporting walls 90 that surround the stack in the supply station and, cooperating with the movable wall 72, support and maintain the stack in a vertical orientation during elevator 82 movement and during the blank transfer procedure.

Figure 6:
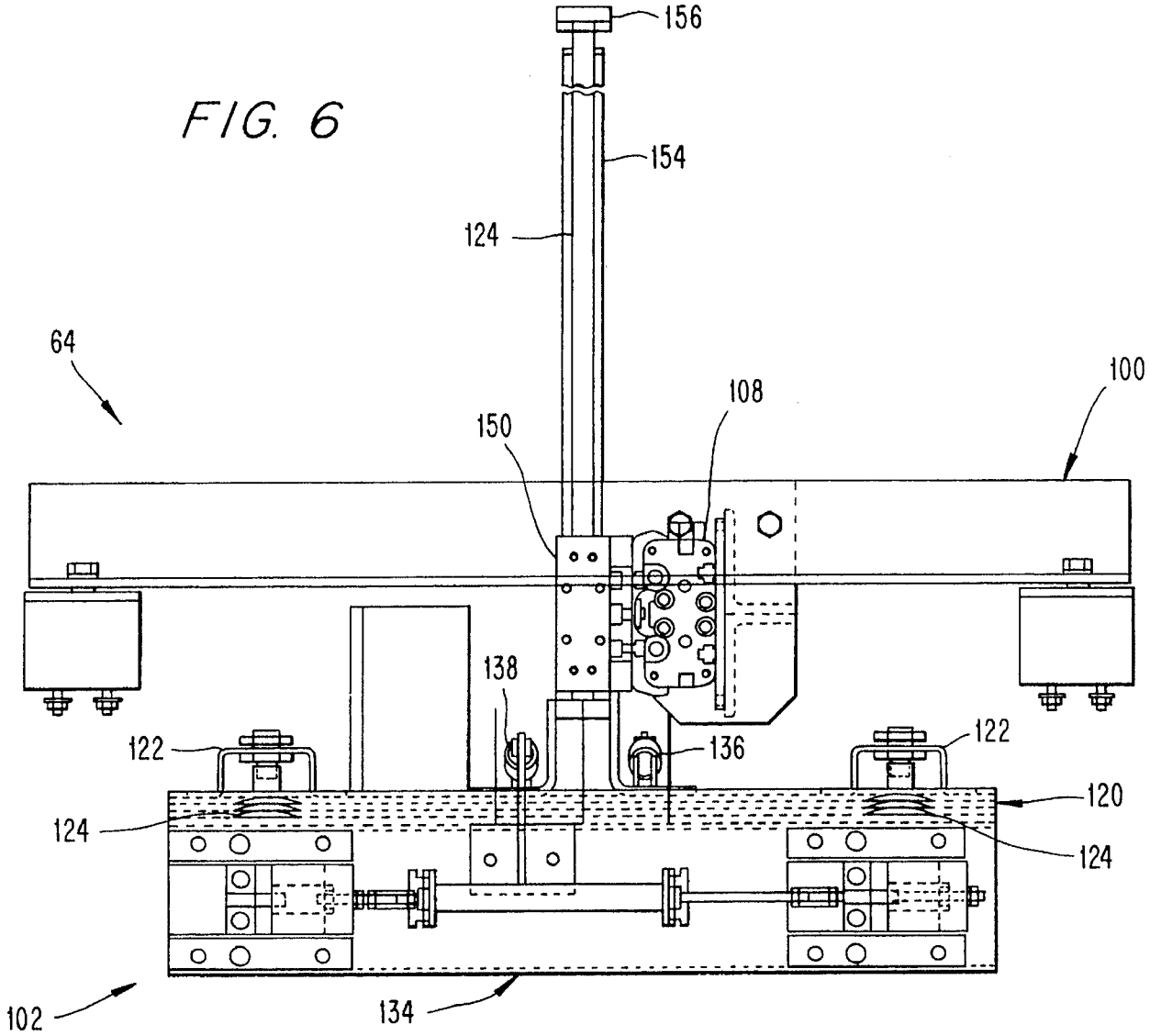
FIG. 6 is a front view of a sleeve transfer means of the apparatus as shown in FIG. 1.
Figures 7, 8:
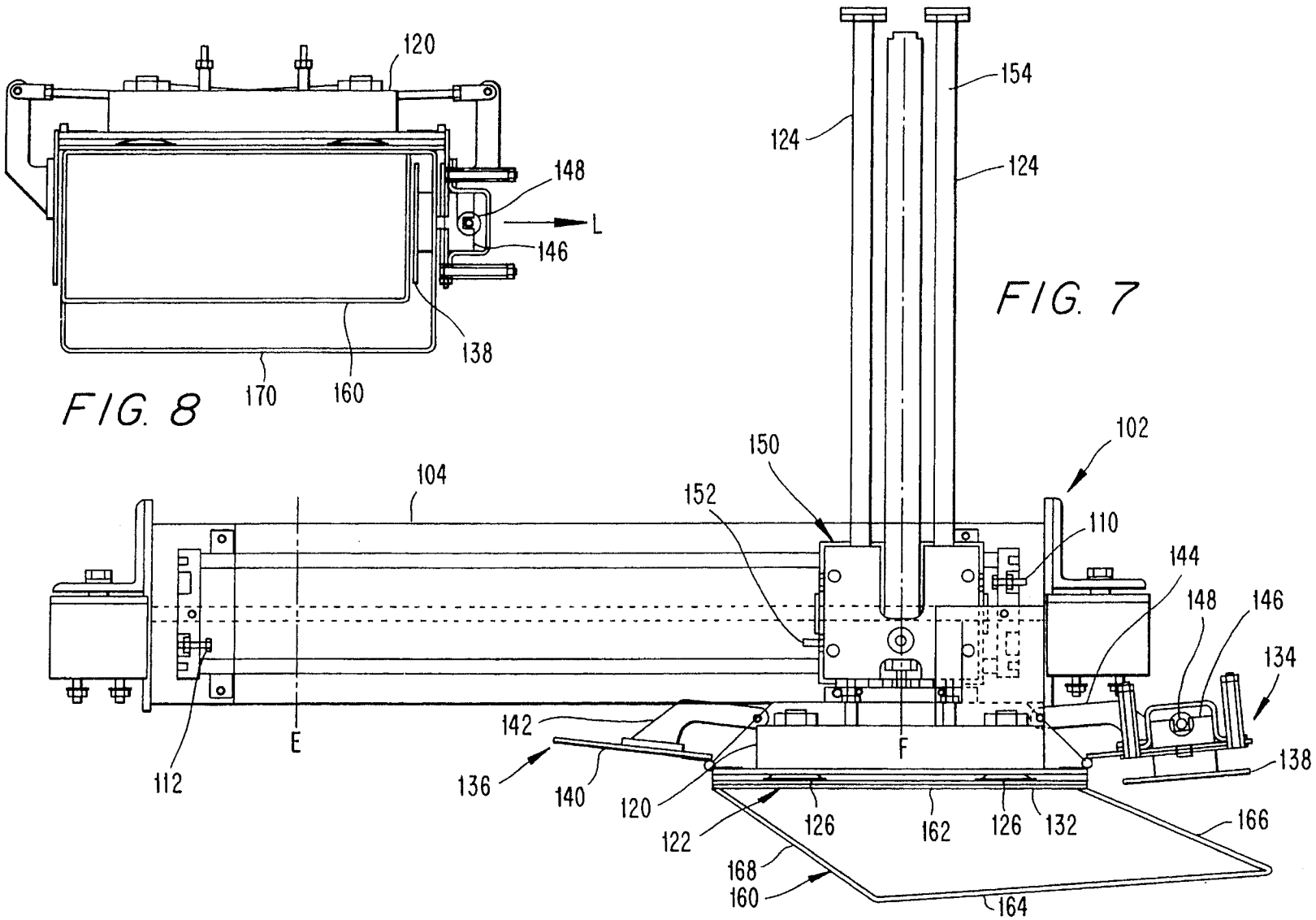
FIG. 7 is a side view the transfer means of FIG. 6.
FIG. 8 is a side view of a carrier of the transfer means of FIG. 6, illustrating sleeve forming means in an operative position for forming a sleeve; and, FIG. 9 is a flow diagram of an automatic tray sleeving method of the present invention.

The sleeve transfer means 64 moves sleeves from the supply station 74 to the sleeving position D for insertion of a tray. FIGS. 7–8 are views of the transfer means 64 removed from the apparatus 10 of FIGS. 1–3 and enlarged to show particular details. FIG. 6 is a front view of the transfer means 64 corresponding to the front view of the apparatus as shown in FIG. 1. FIG. 7 is a side view of the transfer means 64 of FIG. 7. For the spatial and positional relationship of the transfer means 64 to the apparatus 10, reference should be made to FIGS. 1–3 in the following description.

The transfer means 64 is positioned above both the sleeve supply 74 and the tray conveyor 22, and is supported by a frame 100. A carrier 102 for gripping a sleeve blank from the stack and forming the blank into a sleeve tube is mounting on the frame 100. The frame 100 includes a lateral support 104 that enables the carrier 102 to move horizontally between a first position at the supply station 74 for taking a sleeve blank and a second position at the conveyor 22 for inserting a tray in a sleeve. The carrier 102 illustrated in FIG. 7 is shown in the first position. In FIG. 3, the carrier 102 is shown in the second position.

Lateral drive means 108 is provided for moving the carrier 102 between the first and second positions. In a preferred embodiment of the invention, the lateral drive means comprises a pneumatic cylinder and piston attached to the carrier 102 by suitable means. The piston and cylinder are activated pneumatically to move the carrier 102 between the first and second positions.

The carrier 102 includes means for moving between a lower position G at the blank supply 74 for gripping a blank 160, and an upper position F for horizontal movement between the sleeve supply 74 and the sleeving station 22. At the sleeving station 22, the carrier head 120 moves from the upper lateral transfer position E to a lower position D for inserting a tray in a sleeve. The means for vertical movement include an H-block 150 mounted to the carrier 102. Extending upward from the H-block 150 is a pair of guide rod members 124 for guiding the H-block 150 in a vertical path. A pneumatic cylinder 154 controls the vertical movement of the H-block 150 in a preferred embodiment of the invention, however, other drive means are possible.

Position sensing means are provided to monitor the carrier 102 and H-block 150 positions for automatic control of the transfer means 64. A first position sensing means 110 senses the carrier 102 in the position at the sleeve supply station 74. A second position sensing means 112 senses the carrier 102 in the position at the sleeving station 22. H-block sensing means 152 senses the vertical position of the H-block. The position sensors 110, 112, and 152 are integrated with a control system for the automatic operation of the apparatus, as further described below.

The carrier 102 includes a carrier head 120 mounted below the H-block 150. The carrier head 120 includes gripper means 122 for taking a sleeve blank 160 from the supply 74 and sleeve forming means 130 for forming the gripped sleeve blank into an open sleeve.

In a preferred embodiment of the invention, the gripper means comprises four spaced suction cup devices 124 connected to a source for drawing a vacuum (not illustrated). The carrier head 120 is lowered by the cylinder 154 and H-block 150 until the carrier head contacts the a flat portion of the uppermost sleeve blank. The H-block vertical position sensing means senses that the head 120 is lowered to the proper position, and activates the vacuum source to draw a vacuum in the cups 124. The cups 124 adhere to the uppermost blank with sufficient force to lift the blank. When vacuum sensing means senses that a successful vacuum condition exists in the cups 124, the cylinder 154 is signalled to raise the carrier head 120 and lift the gripped blank 160.

The sleeve forming means 130 is mounted to the carrier head 120 for forming a blank 160 held by the gripper means 122 into an open sleeve. The blank 160, which is flat in storage, is shown in FIG. 7 in a partially unfolded state for clarity. The sleeve forming means 130 comprises a stationary plate 132 that makes up the bottom surface of the carrier head 120, and laterally positioned side forming plates. The stationary plate 132 includes apertures to allow the vacuum cups 124 to protrude through for contacting the blank. The stationary plate 132 contacts an upper panel 162 of the gripped blank to hold it flat while the vacuum is activated.

An adjustable former 134 and a fixed side former 136 are located on opposing sides of the carrier head 120. The formers 134, 136 include contact plates 138, 140 mounted on actuators 142, 144. The actuators 142, 144 cause the forming plates 138, 140 to rotate from a clearance position, shown in FIG. 7, to a forming position, shown in FIG. 8. FIG. 8 is a view of the carrier head 120 of FIG. 7 to show the formers 134, 136 in operational position. The plates 138 and 140 contact opposing sides 166 and 168 of the blank 160 and push the sides to unfold the blank along preformed creases to take the open, formed sleeve shaped shown in FIG. 8. The actuators 142 and 144 are activated by solenoid drivers, and may also be activated by other suitable means.

The adjustable former 134 may be adjusted to accommodate the size of blank being used. The forming plate 138 is mounted on a slide 146 that can be moved to positions corresponding to the size MM and EMM sleeves. The slide 146 is operated by a solenoid 148 that responds to a signal from the sleeve size blank size sensor, described above in connection with the blank supply 74. As shown in FIG. 8, the forming plate is positioned for the smaller size MM sleeve. For the large size EMM sleeve 170, the slide 146 is moved by the solenoid in the direction indicated by arrow L.

The sleeve forming means 130 is activated in response to movement of the carrier 102 from the upper position at the blank supply 74 toward the sleeving position. The first position sensor 110 senses that the carrier 102 has moved from the first position, and provides the signal to activate the sleeve former 130.

With the vacuum activated, the sleeve 160 is firmly held and shaped by the forming plates 132, 138 and 140. The sleeve is held in this form as the carrier 102 is transferred to the sleeving position D (see FIGS. 3 and 4), and as support while a tray is inserted in the sleeve.

In an alternative embodiment of the apparatus of the invention, trays of either of the predetermined sizes are handled automatically by the system. A second sleeve supply is provided so that a supply of each of the standard sleeve sizes MM and EMM, may be provided. The tray sensing means 23 senses the size of the tray received at position C. Tray sensing means 23 includes suitably positioned sensors, such photocell devices, that determine the size of the tray. The sleeve transfer means 64 responds to a signal from the tray sensing means 23 by moving to the appropriate sleeve supply and lifting and forming a sleeve, as described above. The sleeve transfer means 64 positions the sleeve and the tray is inserted by the pusher arm 32. After release of the tray, the sleeve transfer means 64 returns to a start position to await the signal from the tray sensor means 23 for the appropriate sleeve.

Figure 9:
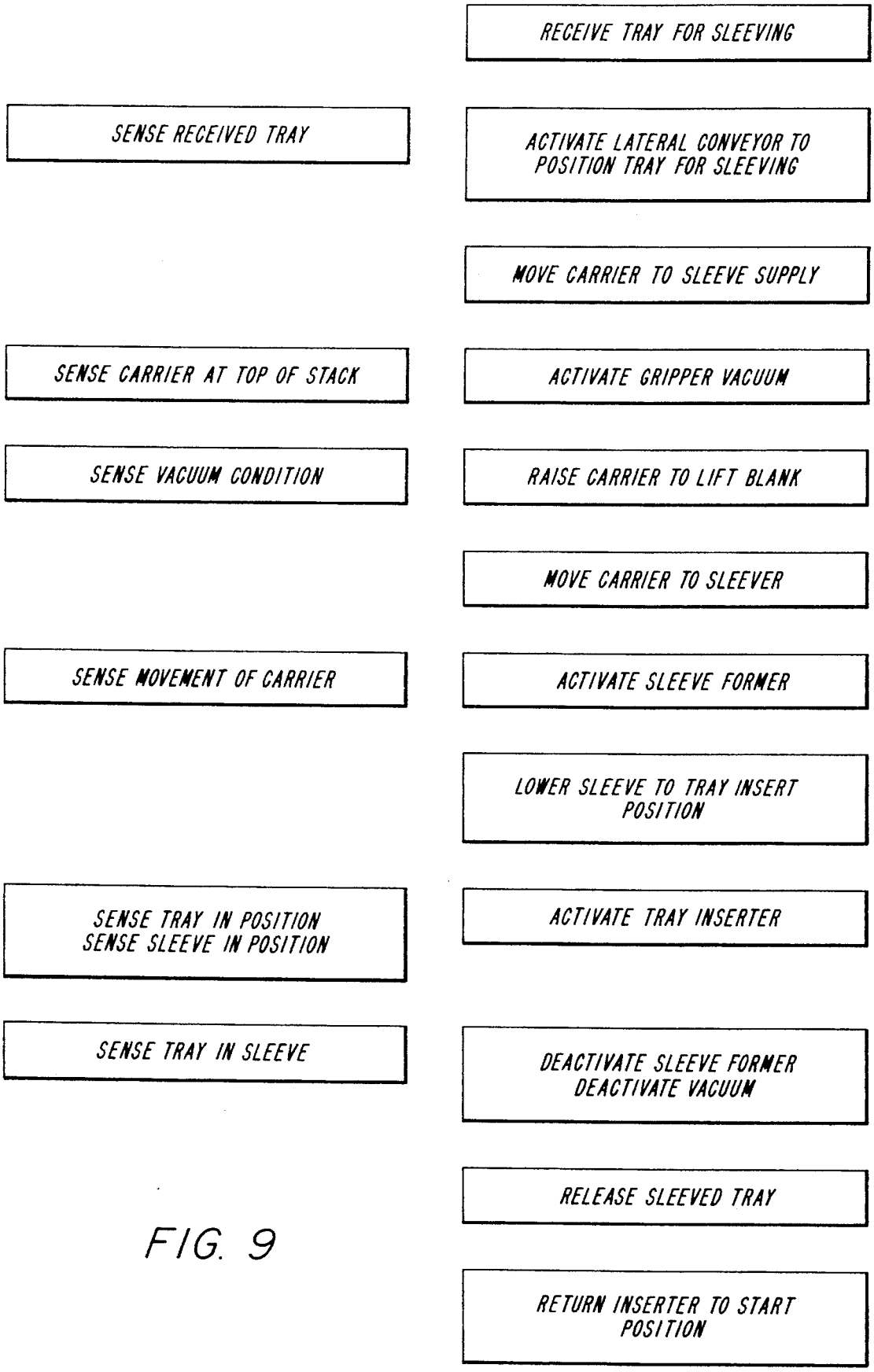

A method for inserting a tray in a sleeve is also provided by the present invention. FIG. 9 is a flow diagram for an automatic sleeving method of the present invention. Reference is also made to FIG. 2 for describing the position of a tray during various steps of the method.

Following the steps of FIG. 9, a loaded tray conveyed to the automatic sleeving apparatus is received for sleeving at a first position. The tray at the first position is sensed and, if the conveyor is clear, released to a second tray position. The tray at the second position is sensed and lateral conveyor means is activated to transfer the tray to an inserting position. Sleeve transfer means moves to the sleeve supply station. When the transfer means is sensed at the stack, the gripper vacuum is activated to grip a sleeve blank from a sleeve blank supply. A vacuum condition in the vacuum is sensed, meaning that the vacuum has successfully attached to a blank, and the gripped sleeve blank is lifted from the supply. The carrier is next moved horizontally to a sleeving position. Horizontal movement is sensed, which activates the forming means to form the blank into an open sleeve. The open sleeve is positioned to accept a tray and sensing means senses that the sleeve and the tray are in position. The tray is then inserted into the prepared and positioned sleeve.

When the tray is sensed in the sleeve, the gripper vacuum and sleeve formers are deactivated to release the sleeved tray for subsequent operations. The inserter is returned to its start position so that the subsequent tray may be moved to the insert position.

In an alternative embodiment of the invention, the size of the tray is first sensed at the tray inserting position, and an appropriate sleeve blank is obtained from a sleeve blank supply for the sensed tray. The remaining steps of transferring and forming the sleeve, and inserting the tray in the sleeve are carried out as described above.

The foregoing has described the preferred principles, embodiments and modes of operation of the present invention; however, the invention should not be construed as limited to the particular embodiments discussed. Instead, the above-described embodiments should be regarded as illustrative rather than restrictive, and it should be appreciated that variations, changes and equivalents may be made by others without departing from the scope of the present invention as defined by the following claims.

What is claimed is:

1. A method for handling articles, comprising the steps of: positioning a tray of articles for inserting the tray in a sleeve; gripping an uppermost sleeve blank from a supply of sleeve blanks;

lifting the gripped sleeve blank from the supply to remove the gripped blank to a position above the supply;

forming the gripped sleeve blank into a sleeve;

positioning the gripped and formed sleeve for accepting a tray; and, inserting the tray of articles into the formed sleeve.

2. The method as claimed in claim 1, wherein the step of gripping the sleeve blank includes contacting the sleeve blank with a carrier having at least one vacuum means and drawing a vacuum so that the sleeve adheres to the carrier.

3. The method as claimed in claim 1, wherein the step of positioning the formed sleeve for accepting a tray includes moving the sleeve horizontally to a position above the tray inserting position and lowering the sleeve to a level in axial alignment with the tray for inserting the tray in the sleeve.

4. The method as claimed in claim 1, further comprising the step of providing a supply of sleeve blanks in stacked vertical relationship and maintaining an uppermost sleeve at a predetermined position.

5. The method as claimed in claim 1, further comprising the step of providing a supply of sleeve blanks having preformed crease lines for forming into sleeves.

6. The method as claimed in claim 1, wherein the step of forming the sleeve blank includes engaging forming plates on opposing side panels of the sleeve blank to unfold the blank along preexisting crease lines and maintain the sleeve in a substantially rectangular configuration.

7. The method as claimed in claim 1, further comprising continuing to grip the sleeve and maintaining the sleeve as formed while the tray is inserted in the sleeve.

8. The method as claimed in claim 1, wherein the step of positioning the tray includes conveying the tray from an article loading station to a position in relationship with tray inserting means for inserting the tray into the sleeve.

9. The method as claimed in claim 1, further comprising the step of sensing gripper means in position at an uppermost sleeve blank, and thereafter gripping of the blank.

10. The method as claimed in claim 1, further comprising the step of sensing a sleeve being gripped and thereafter initiating movement of the sleeve.

11. The method as claimed in claim 1, wherein the step of forming the sleeve is initiated in response to means for sensing the movement of the gripped sleeve blank from the supply of sleeve blanks.

12. The method as claimed in claim 1, further comprising the steps of providing sleeve blanks in separate supplies of different predetermined sizes, sensing the size of the tray of articles positioned for sleeving, and gripping a sleeve blank from the appropriate supply in response to the sensed size of the tray.

13. The method as claimed in claim 1, wherein the step of gripping a sleeve blank further comprises moving gripping means into contact with a flat portion of the uppermost sleeve blank, and initiating gripping means to grip the blank.

14. An apparatus for handling articles, comprising:

sleeve blank supply means for maintaining an uppermost blank of a blank supply at a predetermined position;

gripper means for gripping an uppermost blank from the blank supply;

transfer means for transferring the gripped blank, comprising a carrier to carry the gripped blank, vertical transfer means to remove the carrier from the blank supply and horizontal transfer means to move the vertically removed carrier to a position for inserting a tray in the sleeve;

forming means for forming the blank to a sleeve shape;

means for positioning a tray of articles for inserting into a sleeve; and inserting means for inserting the tray in the sleeve.

15. The apparatus as claimed in claim 14, wherein the gripper means comprises a head for contacting the blank and means for drawing a vacuum in the head sufficient for holding the blank against the head.

16. The apparatus as claimed in claim 14, wherein the sleeve blank supply means includes means for maintaining the blanks in a stacked vertical relationship, and means for lifting the stacked blanks so that the uppermost blank is at predetermined position.

17. The apparatus as claimed in claim 16, further comprising a loading station for accepting a multiplicity of blanks and a loading wall for positioning the accepted blanks for lifting by the elevator.

18. The apparatus as claimed in claim 14, wherein the inserting means comprises a push arm for pushing the tray into the formed sleeve.

19. The apparatus as claimed in claim 14, wherein the inserting means further comprises an insert guide interposed in a tray insert path, said insert guide including a frame through which a tray being inserted passes, and deflectors mounted to the frame, said deflectors being biased toward the tray insert path and being deflected by a tray to open into a sleeve positioned for inserting a tray to guide the tray past edges of the sleeve.

20. The apparatus as claimed in claim 14, wherein the gripper means and the sleeve forming means are mounted on the carrier.

21. The apparatus as claimed in claim 14, wherein the vertical carrier movement means selectively moves the carrier between a lower blank gripping position at the blank supply, an upper position for horizontal movement of the carrier and a lower tray inserting position at the sleeving position.

22. The apparatus as claimed in claim 14, wherein the horizontal movement means moves the carrier between a first position at the blank supply and a second position at the sleeving position.

23. The apparatus as claimed in claim 14, wherein the sleeve forming means comprises forming plates that contact the blank and wherein at least two opposed forming plates move to a position whereby the blank is unfolded to form the blank into a sleeve, the forming plates cooperating with the gripper means to maintain the sleeve form during transferring the sleeve and inserting the tray.

24. The apparatus as claimed in claim 14, wherein the sleeve forming means includes means for adjusting the forming means for forming one of at least two sleeve sizes.

25. The apparatus as claimed in claim 14, further comprising:

means for sensing a tray in position for inserting the tray in a sleeve;

means for sensing the location of the gripper means for gripping a blank;

means responsive to the gripper location sensing means for activating the gripper to grip a blank;

means for sensing a blank being gripped by the gripper means;

means responsive to the gripped blank sensing means for activating movement of the transfer means to lift the gripped blank to an upper horizontal movement position, and then to move the gripped blank from the blank supply to a position above the sleeving position, and then to lower the gripped blank to the sleeving position;

means responsive to the horizontal movement of the transfer means to activate the sleeve forming means; and, means responsive to the formed sleeve being in position for sleeving for activating the tray inserting means.

26. The apparatus as claimed in claim 14, further comprising means for determining the size of a tray of articles, wherein the blank supply means comprises means for supplying sleeve blanks in separate supplies of different predetermined sizes, and means for moving the gripper means to a supply in response to the size of the tray.

27. A method for handling articles, comprising the steps of:

positioning a tray of articles for inserting the tray in a sleeve;

gripping an uppermost sleeve blank from a supply of sleeve blanks;

removing the gripped sleeve blank upward from the supply to a position above the supply;

forming the gripped sleeve blank into a sleeve;

moving the gripped and formed sleeve horizontally to a position above the tray inserting position and lowering the sleeve to a level in axial alignment with the tray for accepting a tray in the sleeve; and, inserting the tray of articles into the formed sleeve.

* * * * *